US007469723B2

(12) United States Patent
Himmelstoss

(10) Patent No.: US 7,469,723 B2
(45) Date of Patent: Dec. 30, 2008

(54) PROCESS FOR MANUFACTURING A HEDDLE, HEDDLE FOR SHED-FORMING MECHANISM, AND LOOM INCORPORATING SUCH A HEDDLE

(75) Inventor: Michael Himmelstoss, Luzinay (FR)

(73) Assignee: Staubli Lyon, Chassieu (FR)

( * ) Notice: Subject to any disclaimer, the term of this patent is extended or adjusted under 35 U.S.C. 154(b) by 34 days.

(21) Appl. No.: 11/522,403

(22) Filed: Sep. 18, 2006

(65) Prior Publication Data

US 2007/0084518 A1 Apr. 19, 2007

(30) Foreign Application Priority Data

Sep. 27, 2005 (FR) ..... 05 09854

(51) Int. Cl.
*D03C 9/00* (2006.01)
*D03C 9/04* (2006.01)
*D03C 13/00* (2006.01)

(52) U.S. Cl. ..... 139/52; 139/53; 139/92; 139/93; 139/94; 139/96

(58) Field of Classification Search ..... 139/52, 139/53, 92–96
See application file for complete search history.

(56) References Cited

U.S. PATENT DOCUMENTS 887,102 A * 5/1908 Lackey ..... 139/96
1,413,949 A * 4/1922 Wagner ..... 139/94
1,930,151 A * 10/1933 Smith ..... 139/94
2,132,245 A * 10/1938 Royle ..... 139/94
3,166,884 A * 1/1965 Steiner et al. ..... 428/369
3,960,182 A * 6/1976 Schwarz ..... 139/91
3,965,939 A * 6/1976 Kulczycki et al. ..... 139/48
3,985,160 A * 10/1976 Kulczycki et al. ..... 139/93
4,342,339 A * 8/1982 Koch ..... 139/93
4,355,665 A * 10/1982 Ramseier et al. ..... 139/96
5,052,446 A * 10/1991 Gysin ..... 139/93
5,092,370 A * 3/1992 Anderson ..... 139/93
6,283,163 B1 * 9/2001 Kagi ..... 139/93

FOREIGN PATENT DOCUMENTS

| | | |
|---|---|---|
| BE | 342071 | 6/1927 |
| EP | B-1015675 | 7/2001 |
| FR | 2267403 | 11/1975 |
| FR | 2776676 | 10/1999 |
| GB | A-1499210 | 1/1978 |
| JP | 57117646 | 7/1982 |

* cited by examiner

*Primary Examiner*—Bobby H Muromoto, Jr.
(74) *Attorney, Agent, or Firm*—Dowell & Dowell, PC

(57) ABSTRACT

This process includes steps consisting in manufacturing an eyelet for guiding a warp yarn, making, in a threadlike element, an opening for receiving the eyelet, and placing and immobilizing the eyelet in the opening. During manufacture of the eyelet at least two projecting tabs offset from each other along its edge and perpendicularly to the principal faces of this eyelet are formed on this outer edge. During the placement of the eyelet in the opening, a part of the edge of the opening is inserted between the tabs. As a variant, the tabs can be provided on the edge of the opening.

13 Claims, 6 Drawing Sheets

PROCESS FOR MANUFACTURING A HEDDLE, HEDDLE FOR SHED-FORMING MECHANISM, AND LOOM INCORPORATING SUCH A HEDDLE

BACKGROUND OF THE INVENTION

1. Field of the Invention

The invention relates to a manufacturing process for a loom heddle. The invention also relates to a heddle for a shed-forming mechanism on a loom, as well as to a loom equipped with such a mechanism.

2. Brief Description of Related Art

In the domain of forming the shed, equipping a heddle with a warp yarn guiding eyelet is known; the material and the shape of this eyelet are chosen so as not to damage the warp yarn traversing the central orifice defined by this eyelet. From FR-A-2 267 403 bonding an eyelet in a longitudinal slit formed in a threadlike element making up a heddle is known. Some eyelets described are provided with an outer peripheral groove intended to make it easier to keep them in the opening of the threadlike element. These eyelets have a thickness greater than that of the threadlike element, which leads to a risk of the warp yarn catching during weaving. Furthermore, such a peripheral groove is difficult to make, especially in high carbon steels used to manufacture the eyelets. In particular, although such a groove is conceivable with circular eyelets, this is achievable only with very very great difficulty, exclusively by machining, in an oblong eyelet. Additionally the oblong eyelet from this prior art does not have a groove, to the point that keeping it in position relative to the threadlike element is somewhat random.

FR-A-2 776 676 calls for the implementation of an oblong-shaped eyelet provided with a groove intended to receive adhesive or welding material. In practice, such a groove is difficult to implement.

EP-A-1 015 675 shows the use of an oblong eyelet forming a groove for receiving two strands making up a threadlike element, in order to keep this eyelet in place, the eyelet further being bonded to these strands. The shape imposed on the eyelet to allow its manufacture by forming is such that significant holes remain respectively above and below the eyelet, these holes having to be filled with adhesive. This is difficult to perform and leads to an increased consumption of adhesive which considerably increases the manufacturing cost of the heddle.

These disadvantages are what the invention more specifically intends to remedy by proposing a novel manufacturing process for a loom heddle which makes possible a more effective attachment of an eyelet the shape of which can be adapted to that of the opening in which it is placed.

SUMMARY OF THE INVENTION

The invention relates to a process for manufacturing a loom heddle, this process including steps consisting in:

a) manufacturing an eyelet for guiding a warp yarn;

b) making an opening for receiving this eyelet in a threadlike element, and c) placing and immobilizing the eyelet in the aforementioned opening.

This process is characterized in that:

d) during the manufacture of the eyelet or the implementation of the opening, on an edge of a first element among the eyelet and the opening, are formed at least two projecting tabs offset from each other both along this edge and perpendicularly to the principal faces of this first element.

e) during the placement of the eyelet in the aforementioned opening, a part of the edge of the second element, among the eyelet and the opening, is engaged with the-projecting tabs.

Thanks to the invention, the projecting tabs provide an effective attachment of the eyelet in the opening of the threadlike element. The offset of the two tabs both along the edge of the eyelet or opening and perpendicularly to the principal faces of the eyelet or the threadlike element corresponds to a "staggered" placement of the tabs which allows them to each interact with one side of the threadlike element or eyelet, all while being able to be manufactured more simply without having recourse to complex machining lines, which is even more significant since the eyelets have very small dimensions. The fact of providing an attachment for the eyelet on the threadlike element through two projecting tabs avoids having recourse to a continuous peripheral groove on the edge of the eyelet. This allows a shape which for this edge can be adapted to the geometry of the opening created in the threadlike element.

According to advantageous but not mandatory aspects of the invention, such a process can incorporate one or more of the following features taken in any technically allowable combinations:

- A step of thinning and sizing the edge intended to be engaged with or inserted between the projecting tabs is provided, the step being prior to step e). This thinning and sizing step is preferably carried out by localized die-stamping of the threadlike element; this die-stamping creates, on each side of this element, a housing for receiving one of the tabs and this thinning step is followed by a step of forming a longitudinal slit in the threadlike element, this slit then being enlarged to-make the aforementioned opening;
- On the edge of the second element, projecting tabs are formed which are complementary to those formed on the edge of the first element; these complementary tabs are offset from each other along the edge of the second element and perpendicularly to the principal faces of the second element, with an inverse distribution from that of the tabs formed on the first element;
- The eyelet or the opening is made by cutting, whereas the tabs are made by die-stamping or forging. This proves particularly economical and is compatible with high speed production.

The invention also relates to a heddle that can be made through the previously mentioned process and, more specifically, a heddle for a shed-forming mechanism on a loom, with this heddle including a threadlike element and also an eyelet immobilized in an opening arranged in this threadlike element. This heddle is characterized in that a first element, among the eyelet and the opening, has, on one edge, at least two projecting tabs offset from each other along this edge and perpendicularly to the principal faces of this first element, whereas a part of the edge of the second element is engaged with these tabs.

Such a heddle is more economical to manufacture than the heddles of the prior art, while it ensures a more effective guiding of the warp yarn without risk of damaging it.

According to advantageous but not mandatory aspects of the invention, such a heddle may incorporate one or more of the following features taken in any technically allowable combinations:

- The thickness of the eyelet is roughly equal to the maximum thickness of the threadlike element, including in the area of the tabs.
- The edge which is partly engaged between the projecting tabs is, at least in the area of its part inserted between these tabs, thinned relative to the maximum thickness of the threadlike element or the eyelet.

The second element has, on one edge, projecting tabs which are complementary to those formed on the edge of the first element; these complementary tabs are offset from each other along the edge of the second element and are perpendicular to its principal faces, with an inverse distribution from that of the tabs formed on the first element.

Each tab is on one of its sides, flush with a principal face of the eyelet or of the threadlike element which is perpendicular to the aforementioned axis.

The threadlike element is made of stainless steel and the eyelet is bonded in the opening provided in this element.

The eyelet or the opening is provided with eight tabs distributed on its outer edge in groups of two tabs offset relative to each other along this edge and in a direction parallel to a central axis of the guiding hole formed by the eyelet.

Finally the invention relates to a loom equipped with a shed-forming mechanism including at least one heddle such as mentioned above.

BRIEF DESCRIPTION OF THE DRAWINGS

The invention will be better understood and other advantages of it will appear more clearly in light of the following description of four embodiments of a heddle conforming to its principle and its manufacturing process, given solely as examples and with in reference to the attached drawings in which.

DETAILED DESCRIPTION OF PREFERRED EMBODIMENTS

Figure 1:
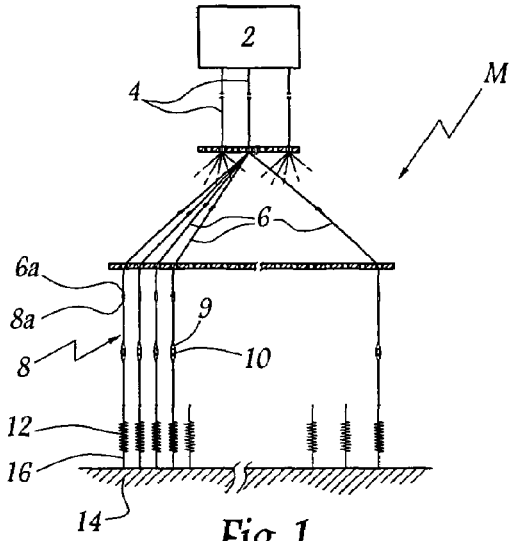
FIG. 1 is a schematic representation of a loom conforming to the invention.

The loom M shown in FIG. 1 is equipped with a Jacquard mechanism 2 which controls several harness strings 4 the lower end of which is associated with several cords 6. The lower end 6*a* of each cord 6 is connected to the upper end 8*a* of a heddle 8, each heddle 8 being provided with an eyelet 9 for passage of a warp yarn 10 and subject to the action of a restoring spring 12 fixed to the frame 14 of the loom through a stem 16.

The heddle 8 is formed from a threadlike element 81 which initially has the shape of a stainless steel wire with circular cross section. This thread is crushed to have a flattened transverse section. In its central part, the element 81 is separated into two branches 82 and 83 between which an opening 84 is defined for receiving the eyelet 9.

The eyelet 9 is obtained by cutting of a strip of metal, preferably a strip of carbon steel. It defines an orifice 91 for passage of the warp yarn 10. The central axis of the orifice 91, is referenced $X_{91}$. This axis is perpendicular to the principal faces 92 and 93 of the eyelet 9, that is its faces with the largest areas.

The eyelet 9 has an oblong shape and its outer edge, which is overall oval or in the form of a flattened ellipse, is referenced 94.

The edge 94 is equipped with eight tabs 95 of which four, bearing the reference 95*a*, have one of their sides flush with the surface 92 whereas the four other tabs, bearing the reference 95*b*, have one of their sides flush with the surface 93.

The tabs 95*a* and 95*b* project relative to the edge 94 and are laid out in pairs along the edge 94, each pair including a tab 95*a* and a tab 95*b*, these tabs being laterally offset from each other along the edge 94.

Figure 5:
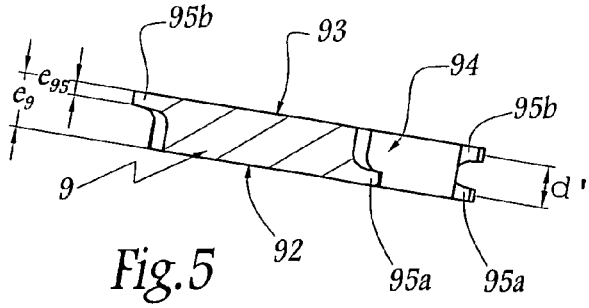
FIG. 5 is a cross section along the line IV-IV on FIG. 4.
Figure 7:
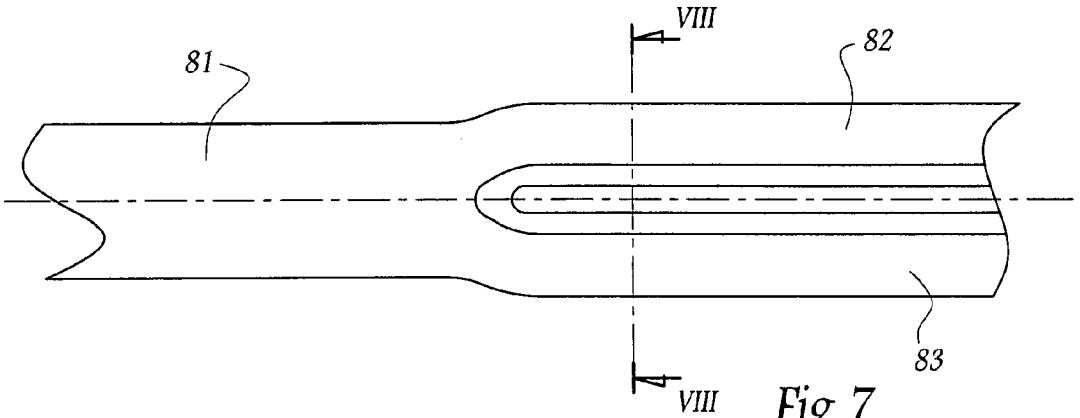
FIG. 7 is a partial front view of a threadlike element intended to make up part of the heddle on FIGS. 2 and 3, during a first manufacturing step.

The median plane of the eyelet 9, i.e a plane parallel to the faces 92 and 93 and equidistant from them, is denoted by $P_9$. The tabs 95*a* and 95*b* are distributed on both sides of this plane. In particular, the tabs 95*a* and 95*b* of a single pair of tabs are offset on both sides of this plane along a direction $D_9$ parallel to the axis $X_{91}$. Looking at the section of the eyelet 9 shown in FIG. 5, it could be considered that the tabs 95*a* and 95*b* are placed in staggered rows on both sides of the plane $P_9$. The tabs 95*a* and 95*b* from a single pair are offset along the edge 94 by a non-zero distance d, and parallel to the direction $D_9$, by a distance d', taken between the centres of the tabs 95*a* and 95*b*, which is also non-zero.

Figure 6:
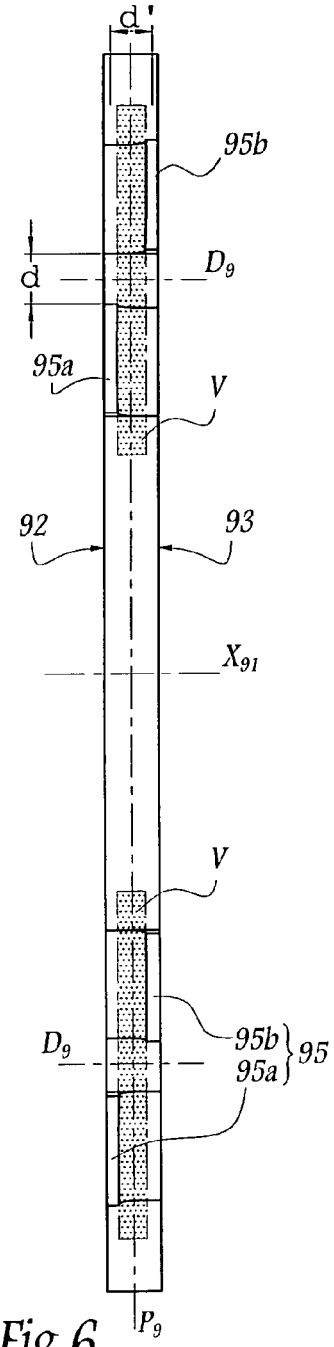
FIG. 6 is a side view in the direction of the arrow VI on FIG. 4.

The succession of two tabs 95*a* and 95*b* from a single pair forms a volume V, shown in grey in FIG. 6 with a width d', in which the edge 85 of the opening 84 can be partially introduced in order to firmly retain the eyelet 9 in position in this opening.

In order to be able to be introduced in this grey volume V, the edge 85 is thinned as shown on FIGS. 7 to 10. When the element 81 is shaped to make the heddle 8, it is die-stamped along a length corresponding to the largest dimension of the opening 84 to form, from each of its largest dimensions or principal faces 86 and 87, two housings 86*a* and 87*a* which each extend on two depths $P_1$ and $P_2$ where the larger depth $P_2$ corresponds to the central zone of each of the housings 86*a* and 87*a*.

Figure 4:
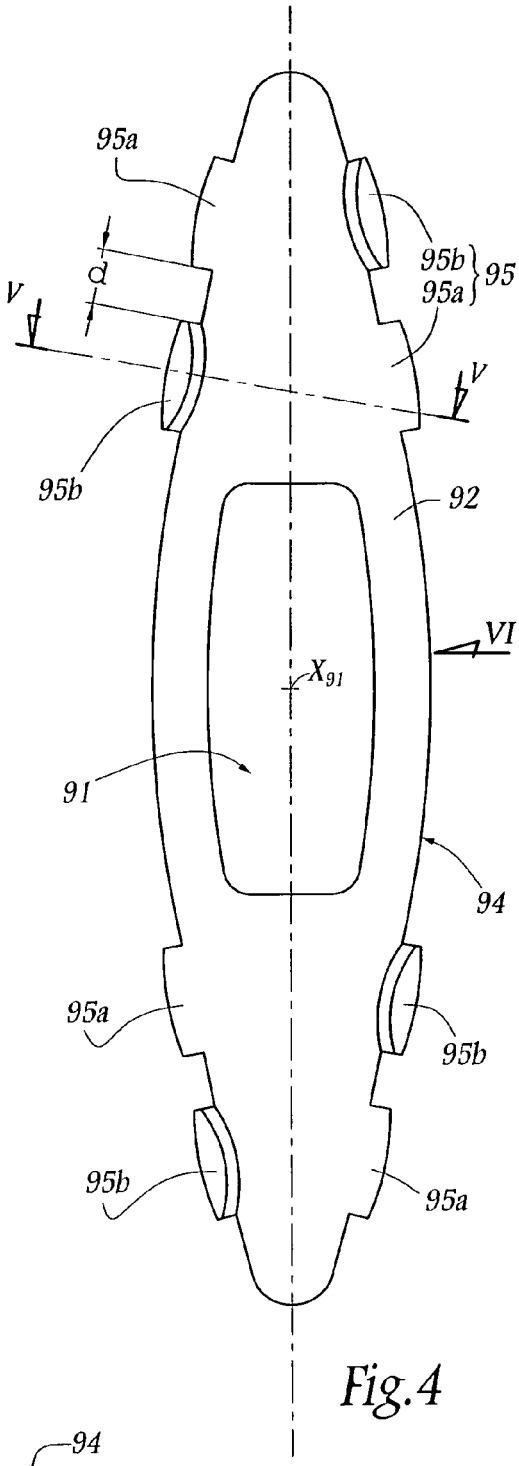
FIG. 4 is a front view at a larger scale of the eyelet from the heddle on FIGS. 2 and 3.
Figure 9:
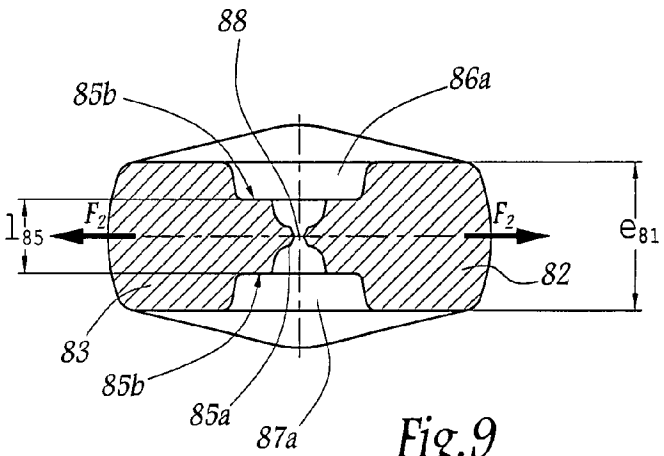
FIG. 9 is a cross section analogous to FIG. 8, during a second manufacturing step.
Figure 8:
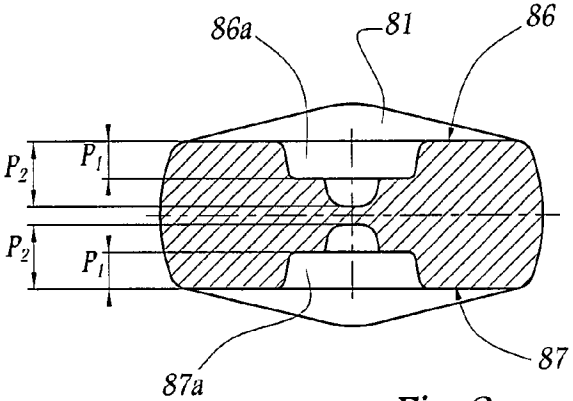
FIG. 8 is a cross section along the line VIII-VIII on FIG. 7.

Once the housings 86*a* and 87*a* have been formed by die-stamping of the element 81, a slit 88 is created in their bottom part, as shown in FIG. 9. This slit joins the deepest parts of the housings 86*a* and 87*a*. By the formation of this slit 88, branches 82 and 83 are created which can then be separated from each other, in the direction of the arrows $F_2$ in FIGS. 9 and 10, to reach the position of FIG. 10 where the branches 82 and 83 define between them the opening 84 with transverse dimensions greater than the dimensions of the eyelet 9 in the plane visible on FIG. 4.

At the end of this operation, the edge 85 forms, on its entire length, a sized nose 85*a* on both sides of which are arranged two shoulders 85*b* of depth $p_i$. The nose 85*a* has a width $l_{85}$ measured parallel to the axis $X_{91}$, less than the thickness $e_{81}$ of the element 81 and than the distance d'.

Figure 10:
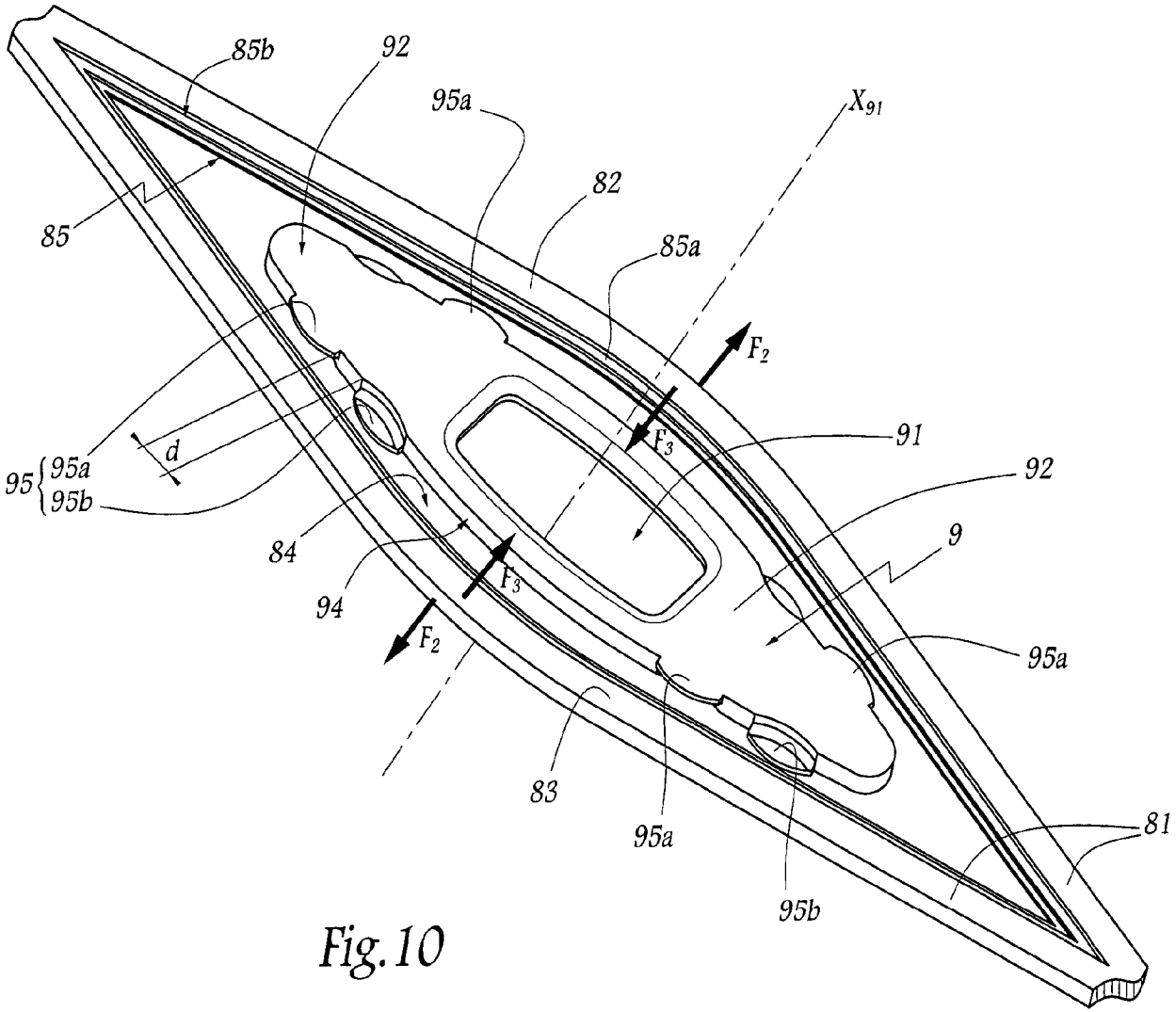
FIG. 10 is a perspective view analogous to FIG. 2, during a third manufacturing step.

As shown in FIG. 10, it is then possible to place the eyelet 9 in the opening. 84 after having pulled away the branches 82 and 83 by elastic deformation, and then letting them come back towards each other in the direction of the arrows $F_3$ in this figure, which comes back to insert locally, meaning to engage, the nose 85*a* of the edge 85 in the volumes V defined by the two tabs 95*a* and 95*b* of each pair of tabs. The eyelet 9 is then held, firmly and without play by the branches 82 and 83.

To ensure the durability of the attachment and fill the holes between the eyelet 9 and the element 81, adhesive is applied in the holes 84*a* which remain on both sides of the eyelet 9. By capillarity the adhesive spreads in the area of at least part of the interface between the edge 85 and the eyelet 9. This adhesive can be of any known type and, in particular, a single-component epoxy adhesive cured by ultraviolet radiation, or an anaerobic adhesive cured by ultraviolet radiation.

Figure 3:
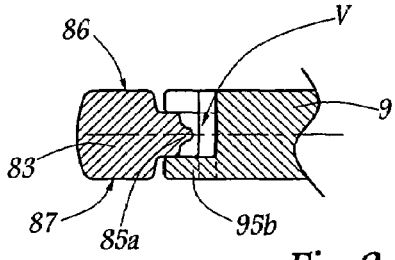
FIG. 3 is a partial principal section at a larger scale along the line III-III on FIG. 2.
Figure 2:
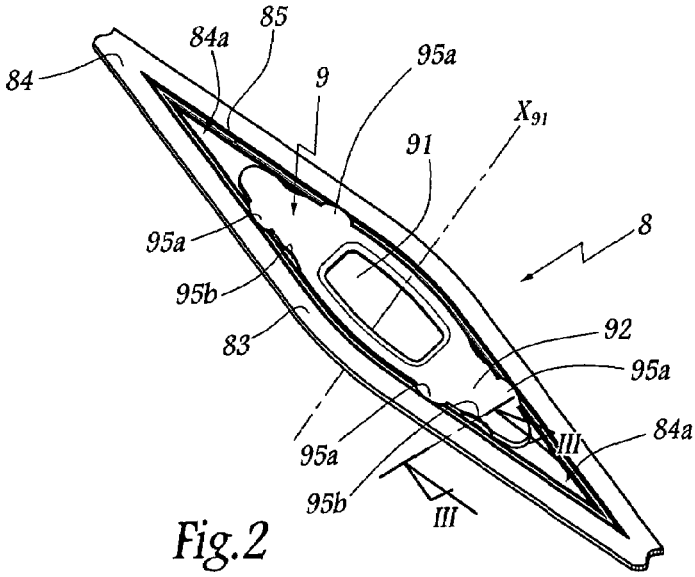
FIG. 2 is a perspective view at a larger scale of the central part of a heddle for the loom from FIG. 1.

The thickness of each of the tabs 95 is referenced $e_{95}$. This thickness is slightly less than the depth $P_1$ of the housings 86*a* and 87*a*. Further, the total thickness $e_9$ of the eyelet 9 is chosen roughly equal to the thickness $e_{81}$. Thus, when the eyelet 9 is pinched and bonded in the opening 84 as shown in FIG. 3, its faces 92 and 93 can be flush with the faces 86 and 87 of the element 81, since the tabs 95 are received in the shoulders 85*b* of both sides of the nose 85*a*.

The positioning of the tabs 95*a* and 95*b*, which are offset from each other along the edge 94, makes it possible to make these tabs by die-stamping of the steel strip out of which the eyelet 9 is cut. As a variant, the eyelet can be made by cold forging. The fact of using die-stamping or forging for creating the tabs 95 avoids having to use machining operations which would be very costly and delicate to implement considering the size of the eyelet 9 whose length in practice is less than 20 mm, preferably less than 10 mm.

In consideration of the manufacture method for the eyelets 9 by cutting, die-stamping and/or forging, it is not necessary to make use of a circular slug of the type of that used in FR-A-2 267 403 or EP-A-1 015 675, which makes it possible to adapt the shape of the edge 94 to the final shape of the opening 84. So, the holes 84*a* that may need to be filled with adhesive can be of reduced size compared to the total surface of the opening 84.

The manufacture method for the eyelets 9 enables very high production rates because the various operations used can be done on a single machine with several work positions, and the shaping tools all have displacements perpendicular to the plane $P_9$.

The fact that the eyelet is bonded to the element 81 and not welded onto it allows this element 81 to be made of stainless steel. The use of a stainless steel element 81 makes it possible to dispense with conventional nickel plating operations on non-stainless steel elements, while these nickel plating operations are likely to generate the appearance of burrs or "scratchings" which can damage or cut the warp yarn.

Figure 11:
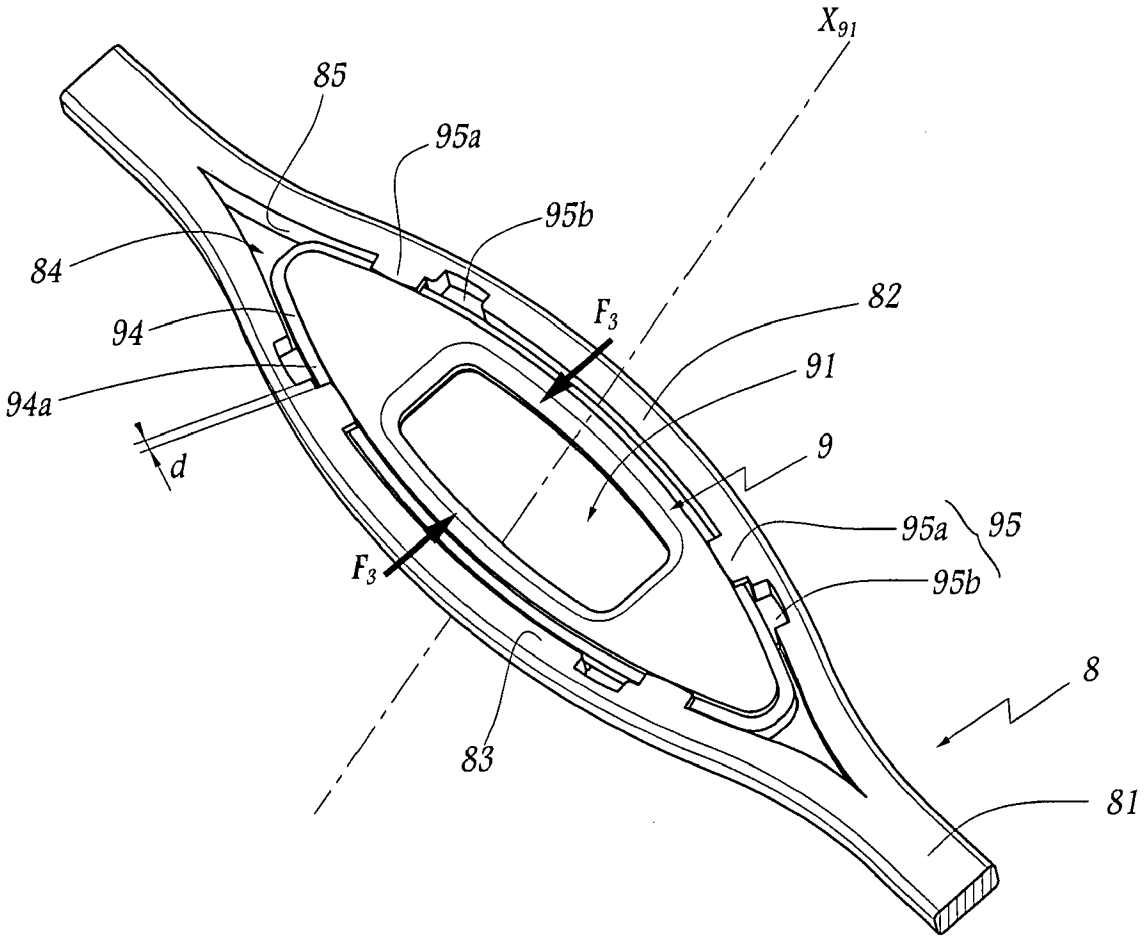
FIG. 11 is a view analogous to FIG. 2 for a heddle conforming to a second embodiment of the invention.

In the second embodiment of the invention shown in FIG. 11, the elements analogous to those from the first embodiment have identical references. This embodiment shows an inverted or "mirror" solution relative to the first embodiment in the sense that the tabs 95*a* and 95*b* are distributed on the edge 85 of the opening 84 arranged in the threadlike element 81 of the heddle 8, whereas the outer edge 94 of the eyelet 9 is thinned and has a nose 94*a* thinner than the eyelet and intended to be inserted in the volume defined by the two adjacent tabs 95*a* and 95*b* of a single pair of tabs 95. As in the first embodiment, the tabs 95*a* and 95*b* are staggered, being offset from each other both parallel to the edge 85, as shown by the distance d in FIG. 11, and perpendicularly to it along the direction of the axis $X_{91}$ of the orifice 91 defined by the eyelet 9.

The tabs 95*a* and 95*b* are flush to the lateral faces of the threadlike element 81.

As in the first embodiment, the eyelet 9 can be immobilized by a clamping force $F_3$ due to the branches 82 and 83 of the element 81 and by being bonded, in order to obtain additional anchoring.

Figure 12:
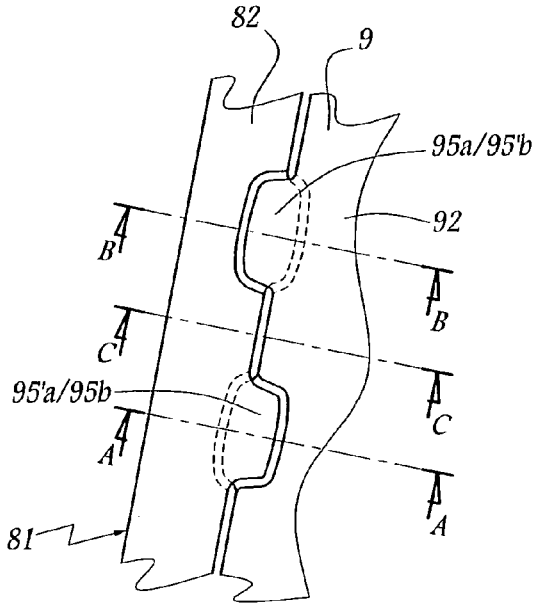
FIG. 12 is a partial representation of the edge of an eyelet and the edge of an opening of a threadlike element of a heddle conforming to a third embodiment of the invention.
Figure 13:
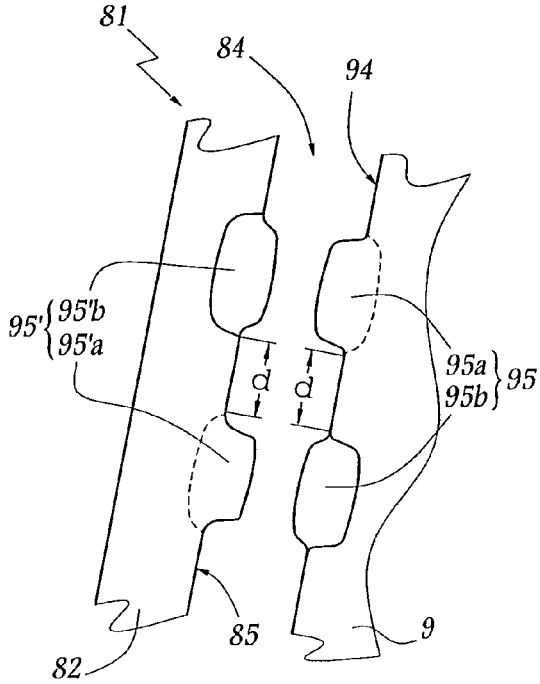
FIG. 13 is a view analogous to FIG. 12 where the heddle is undergoing manufacture during a step corresponding to FIG. 10 for the first embodiment.

As shown in FIGS. 12 and 13 where the elements analogous to those from the first embodiment have the same references, the edge 94 of the eyelet 9 can be provided with two tabs 95*a* and 95*b* which form a pair of tabs 95 which are offset as in the first embodiment. The tab 95*a* is flush with a principal face 92 of the eyelet 9, whereas the tab 95*b* is flush with the opposite principal face 93.

Similarly, the edge 85 of the branch 82 of the threadlike element 81 is provided with two projecting tabs 95', specifically one tab 95'*a* flush with the principal face 86 of the branch 82 and one tab 95'*b* flush with the opposite face 87 of this branch. The tabs 95' are offset from each other along the edge 85 by a distance d identical to the offset distance d of the tabs 95 relative to each other along the edge 94. The tabs 95' are also offset from each other perpendicularly to the faces 86 and 87 by a distance d' between their respective centres, just like the tabs 95 are offset perpendicularly to the faces 92 and 93 by the same distance d'. The direction of offset of the tabs 95' perpendicularly to the faces 86 and 87 is the inverse of that of the tabs 95.

Figure 12A:
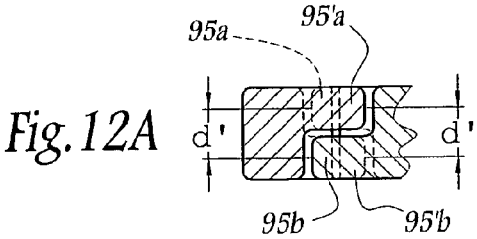
FIGS. 12A, 12B and 12C are respectively cross sections along the lines A-A, B-B and C-C on FIG. 12.
Figure 12B:
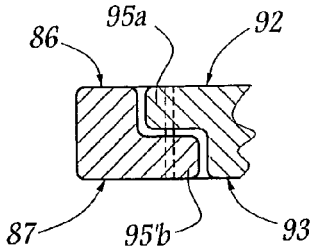

It is thereby possible during the placement of the eyelet 9 in the opening 84 to bring the tabs 95*a* and 95'*b* into a position overlapping one another whereas the tabs 95'*a* and 95*b* are brought into a position overlapping one another, as shown respectively in FIGS. 12A and 12B.

Figure 12C:
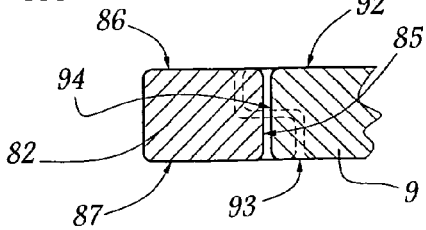

In the portions of the edges 94 and 85 free of tabs, these edges are straight and perpendicular to the principal faces 86 and 87, and 92 and 93 of the elements 9 and 81, as shown in FIG. 12C.

Figure 14A:
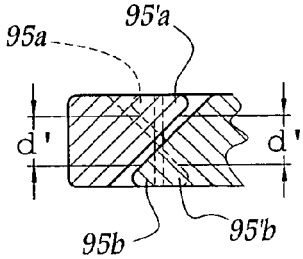
FIGS. 14A and 14B are cross sections analogous respectively to FIGS. 12A and 12B for a heddle conforming to a fourth embodiment of the invention.
Figure 14B:
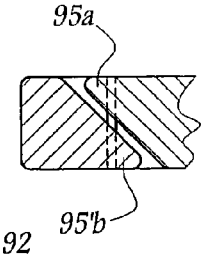

As the FIGS. 14A and 14B show, the tabs 95*a*, 95*b*, 95'*a* and 95'*b* can be chamfered, that is having a surface inclined at about 45° to the principal faces 86, 87, 92 and 93 of the elements 81 and 9, while being offset perpendicularly to these faces by a distance d', along the edges 85 and 94.

As a variant, in the four embodiments described, as the blocking of the eyelet 9 in the opening 84, obtained through the elasticity of the branches 82 and 83, is very effective, the bonding of the eyelet in this opening can be eliminated.

The invention was shown in the first two embodiments with an eyelet and an opening whose edge 94 or 85 is equipped with eight tabs 95. In practice, the number of tabs 95 results from a design choice by a specialist who may decide to use only two of these tabs or an arbitrary number of them. This number can be less or more than eight. When more than two tabs are used, they are advantageously distributed along the length of the edge 94 or 85, preferably in pairs.

The invention was shown in its implementation for the manufacture of a heddle for a Jacquard type loom. It also applies to the manufacture of a heddle intended to be mounted on a loom frame, this frame being driven by a weave mechanism, for example a dobby or basic weave mechanism.

The invention claimed is:

1. A process for manufacturing a loom heddle, the process comprising the steps of:

a) manufacturing an eyelet for guiding a warp yarn, b) making an opening for receiving the eyelet in a threadlike element, and c) placing and immobilizing the eyelet in the opening, wherein d) during the manufacture of the eyelet or the making of the opening, forming on an edge of one of the eyelet and the opening at least two projecting tabs offset from each other both along the edge and perpendicularly to principal oppositely oriented faces of the one of the eyelet and the opening, and e) during the placement of the eyelet in the opening, engaging the tabs with a part of an edge of the other of the one of the eyelet and the opening.

2. The process according to claim 1, further comprising the step of thinning and sizing the edge of the other of the one of the eyelet and the opening intended to be engaged with the tabs, the step of thinning being prior to the step of placing the eyelet in the opening.

3. The process according to claim 2, wherein the step of thinning and sizing is carried out by localized die-stamping of the threadlike element, wherein the die-stamping induces on each of two sides of the threadlike element the creation of a housing for receiving one of the tabs, and wherein the step of thinning is followed by a step of forming a longitudinal slit in the threadlike element and a step of enlarging the slit to make the opening.

4. The process according to claim 1, further comprising the step of forming on the edge of the other of the one of the eyelet and the opening projecting tabs which are complementary to the tabs formed on the edge of the one of the eyelet and the opening, the complementary projecting tabs on the edge of the other of the one of the eyelet and the opening being offset from each other along the edge of the other of the one of the eyelet and the opening and perpendicularly to principal oppositely oriented faces of the other of the one of the eyelet and the opening, with an inverse distribution from that of the tabs formed on the one of the eyelet and the opening.

5. The process according to claim 1, wherein the eyelet or the opening is made by cutting, and the tabs are made by die-stamping or forging.

6. A heddle for a shed-forming mechanism on a loom, comprising: a threadlike element and an eyelet immobilized in an opening arranged in said threadlike element, wherein one of said eyelet and said opening has, on an edge, at least two projecting tabs offset from each other along said edge and perpendicularly to principal faces of said one of said eyelet and said opening, and a part of an edge of the other of said one of said eyelet and said opening, is engaged with said tabs.

7. The heddle according to claim 6, wherein the thickness of said eyelet is roughly equal to a maximum thickness of said threadlike element, including in an area of said tabs.

8. The heddle according to claim 6, wherein said edge of said other of said one of said eyelet and said opening which is partly engaged with said tabs is, at least in an area of the part of said edge inserted between said tabs, thinned relative to a maximum thickness of said threadlike element or said eyelet.

9. The heddle according to claim 6, wherein said other of said one of said eyelet and said opening has, on one edge, projecting tabs which are complementary to said tabs formed on said edge of said one of eyelet and said opening, said complementary projecting tabs on said edge of said other of said one of said eyelet and said opening being offset from each other along said edge of said other of said one of said eyelet and said opening and perpendicularly to principal oppositely oriented faces of said other of said one of said eyelet and said opening, with an inverse distribution from that of the tabs formed on said one of said eyelet and said opening.

10. The heddle according to claim 6, wherein each tab is, on one side of the tab, flush with one of said principal faces of said eyelet or said threadlike element.

11. The heddle according to claim 6, wherein said threadlike element is of stainless steel and said eyelet is bonded in said opening.

12. The heddle according to claim 6, wherein said eyelet or said opening is provided with eight tabs distributed on its edge in groups of two tabs offset relative to each other along said edge and in a direction parallel to a central axis of a guiding hole formed by said eyelet.

13. A loom equipped with a shed-forming mechanism, said shed-forming mechanism comprising at least one heddle including a threadlike element and an eyelet immobilized in an opening arranged in said threadlike element, wherein one of said eyelet and said opening has, on an edge, at least two projecting tabs offset from each other along said edge and perpendicularly to principal faces of said one of said eyelet and said opening, and a part of an edge of the other of said one of said eyelet and said opening is engaged with said tabs.

* * * * *